US009149902B2

(12) United States Patent
DeCore et al.

(10) Patent No.: US 9,149,902 B2
(45) Date of Patent: Oct. 6, 2015

(54) SLUG RETENTION GROOVE FORMING MACHINE AND METHOD

(71) Applicant: DTC Products, St. Charles, IL (US)

(72) Inventors: Jeffrey A. DeCore, St. Charles, IL (US); Robert B. DeCore, Batavia, IL (US)

(73) Assignee: DTC Products, Inc., St. Charles, IL (US)

( * ) Notice: Subject to any disclaimer, the term of this patent is extended or adjusted under 35 U.S.C. 154(b) by 60 days.

(21) Appl. No.: 13/828,399

(22) Filed: Mar. 14, 2013

(65) Prior Publication Data

US 2013/0252517 A1 Sep. 26, 2013

Related U.S. Application Data

(60) Provisional application No. 61/612,226, filed on Mar. 16, 2012.

(51) Int. Cl.
*B24B 19/20* (2006.01)
*B24B 23/02* (2006.01)

(52) U.S. Cl.
CPC ..... *B24B 19/20* (2013.01); *B24B 23/026* (2013.01)

(58) Field of Classification Search
CPC ..... B24B 19/20; B24B 23/026; B24B 23/00; B24B 23/08
USPC ..... 451/344, 340, 363, 358, 294, 295, 231, 451/233, 439
See application file for complete search history.

(56) References Cited

U.S. PATENT DOCUMENTS

| | | | | |
|---|---|---|---|---|
| 3,507,140 | A | 4/1970 | Tassaro | |
| 3,959,929 | A * | 6/1976 | Fleischmann et al. | 451/174 |
| 4,022,106 | A * | 5/1977 | Kile | 409/178 |
| 4,516,450 | A | 5/1985 | Shuttleworth | |
| 4,543,865 | A | 10/1985 | Kramski | |

(Continued)

FOREIGN PATENT DOCUMENTS

| | | |
|---|---|---|
| JP | 62-188667 | 8/1987 |
| RU | 2283238 | 9/2006 |

(Continued)

OTHER PUBLICATIONS

"Mate Slug Free Dies—Eliminate Slug Pulling", Mate Precision Tooling, Mate Precision Tooling, Anoka, Minnesota, LIT00520, undated.

(Continued)

*Primary Examiner* — Robert Rose
(74) *Attorney, Agent, or Firm* — Boyle Fredrickson S.C.

(57) ABSTRACT

A portable and transportable die cavity modifying machine having a base carrying a carriage adjustable along one axis, e.g., a generally horizontal axis, and a machining head adjustable along another axis, e.g., a generally vertical axis, for modifying a die cavity of a stamping die in a manner that prevents blank or slug pulling during stamping press operation. The machine includes a grinder that can be pneumatically powered having a grinding bit used to precisely machine a slug retention groove in a die cavity defining surface (sidewall) of a die cavity formed in a stamping die. The machine has an angularly adjustable head carrying the grinder enabling adjustment of the angle of the groove relative to die cavity defining surface enabling the groove to be angled relative to the direction of a punch entering the die cavity during stamping.

32 Claims, 12 Drawing Sheets

(56) References Cited

U.S. PATENT DOCUMENTS

| | | | | |
|---|---|---|---|---|
| 4,807,403 | A | 2/1989 | Kobayashi et al. | |
| 5,032,151 | A * | 7/1991 | Klein et al. | 95/17 |
| 5,136,907 | A | 8/1992 | Bakermans et al. | |
| 5,161,299 | A * | 11/1992 | Denison et al. | 29/603.13 |
| 5,694,804 | A | 12/1997 | Grabbe | |
| 6,357,094 | B1 * | 3/2002 | Sugimoto | 29/27 C |
| 6,640,603 | B2 | 11/2003 | Roberts | |
| 6,818,083 | B2 | 11/2004 | McAmish et al. | |
| 7,210,384 | B2 | 5/2007 | Elynuik | |
| 2004/0216577 | A1 | 11/2004 | McCrudden | |

FOREIGN PATENT DOCUMENTS

| | | |
|---|---|---|
| RU | 76588 | 9/2008 |
| SU | 1315142 | 6/1987 |
| SU | 1713426 | 2/1992 |

OTHER PUBLICATIONS

"Reduce Excesive Manufacturing Costs Associated With Slug Pulling in Your Stamping Operations", Oberg Industries, Freeport, PA, undated.

"Whitney SlugMagic(TM) Slug Retaining Discs", Whitney—A Division of MegaFab, Rockford, IL, undated.

"Problem identified . . . (Every Diemaker's No. 1 Problem)", Kramski GmbH, undated.

"Oberg Carbide Punch & Die / Standard Tolerace" Matis, Inc. Bridgeview, IL, undated.

"Oberg Slug Retention", Matis, Inc., Bridgeview, IL, undated.

"Dayton Slug Control System", Dayton Progress Corporation, Dayton, Ohio, Form #963M. Sep. 2003.

"Dayton Slug Control System", Dayton Progress Corporation, Dayton, Ohio, Form #953, Jun. 1996.

* cited by examiner

SLUG RETENTION GROOVE FORMING MACHINE AND METHOD

CROSS REFERENCE

This application claims priority under 35 U.S.C. §119(e) to U.S. Provisional Patent Application No. 61/612,226, filed Mar. 16, 2012, which is expressly incorporated by reference herein

FIELD

The present invention relates generally to a machine and method for modifying a cavity of a die to retain slugs or blanks within the die cavity so the slug or blank does not pull out of the die during stamping operation. In a preferred embodiment, the present invention is directed to a portable and transportable slug retention groove forming machine, a "slug keeper" machine, used to machine slug keeper grooves in the sidewall of a die cavity or die opening of a die even while the die is still in the stamping press.

BACKGROUND

During metal stamping, a sheet of metal is positioned over a die opening or die cavity before a punch is rapidly pushed through the sheet into the die opening or cavity of cutting a blank or slug from the sheet having substantially the same shape or contour as the profile of the die cavity. Particularly, where the blank or slug is intended to be pushed through the die cavity, retraction of the punch can cause the blank or slug to undesirably pull out of the die.

To prevent circular blanks or slugs from pulling out of the die, Kramski, U.S. Pat. No. 4,543,865, discloses machining a small groove into part of the sidewall defining the die cavity that provides interference by causing part of the blank or slug formed during stamping to expand into the groove. As a result of the blank or slug expanding into the groove during stamping, pressure between the blank or slug and die land occurs preventing the blank or slug from pulling back through the top of the die and onto the work zone.

What is needed is a machine and method for machining one or more slug keeping grooves or slug retention grooves in a die. What is also needed is a machine and method usable in the field to machine one or more slug keeping/retention grooves in a die without having to remove the die from the stamping press.

SUMMARY

The present invention is directed to a machine for modifying a cavity of a stamping die by forming an elongate slug retention groove in the die that helps prevent pulling of a blank or slug during stamping press operation using the modified die. In a preferred embodiment, the die cavity modifying machine is a portable or transportable slug retention groove forming machine equipped with a base carrying an adjustable carriage which in turn carries a machining head that utilizes a machining insert, preferably a rotary grinding bit, to modify the stamping die to provide slug retention by machining a slug retention groove in a die cavity sidewall of the stamping die. The base of the machine is constructed and arranged to enable the machine to be stably anchored in place during use with a preferred base having a mount configured to releasably yet securely mount the machine on a surface adjacent the stamping die to be modified using the machine.

The carriage of the slug retention groove forming machine is adjustable along a first axis toward or away from the stamping die and the machining head carried by the carriage is adjustable along a second axis generally parallel to a die punch travel direction. The machining head can also be angularly adjustable relative to the carriage and second axis enabling adjustment of the angle of the machining insert, preferably rotary grinding bit, relative to the second axis and the die punch travel direction to help machine a slug retention groove in a stamping die where the groove is oriented at an acute angle relative to the direction of a stamping punch entering the die.

The carriage is movable relative to the base along the first axis preferably in a generally horizontal direction and can extend outwardly from the base beyond the base locating the machining head outwardly of the base. The base carries a first generally horizontal slide arrangement that includes a horizontal slide and drive enables the carriage to move relative to the base along the first or generally horizontal axis. Movement of the carriage generally horizontally relative to the base along the first axis also moves the machining head generally horizontally in unison with the carriage relative to the base along the first axis in a direction toward or away from the stamping die. The drive includes or cooperates with a position indicator that can in the form of a micrometer equipped with a digital display that facilitates precise horizontal positioning of the machining head relative to the stamping die.

The machining head of the slug retention groove forming machine is mounted to the carriage by a second generally vertical slide arrangement with the machining head preferably disposed outwardly of the base by the carriage and movable relative thereto along the second axis in a generally vertical direction enabling positioning of the rotary grinding bit into or out of the die cavity of the stamping die. The machining head preferably also is angularly adjustable to enable adjustment of an angle of the rotary grinding bit relative to the die cavity to enable a slug retention groove to be machined in a die cavity sidewall that is acutely angled relative to the direction of die press movement during stamping operation. Such angular adjustment preferably is provided by a swivel assembly disposed between the machining head and carriage.

The machining head preferably uses a rotary grinder with a machining insert that preferably is a rotary grinding bit to machine the slug retention groove in part of the die cavity defining sidewall of the stamping die. A preferred machining head includes a clamping assembly that releasably clamps the rotary grinder in a manner that permits positioning of the rotary grinding bit of the grinder along the second axis by enabling the grinder to be clamped closer to or farther way from the die. In a preferred embodiment, the rotary grinder is a pencil grinder or micro-grinder and preferably is air or pneumatic powered.

The base of the slug retention groove forming machine includes a mount at enables the machine to be releasably secured to a surface adjacent the stamping die to be modified by machining a slug retention groove in its die cavity defining sidewall. A preferred mount is a magnetic mount used to releasably attach the die cavity modifying machine to a magnetically attractive mounting surface that can be an outer or top surface of the die still mounted in its stamping press or a magnetically attractive workholding surface, such as a workbench or table, located in tool room where the die is being prepared for use in a stamping press. A preferred magnetic mount includes an actuator, such as in the form of a lever or knob, used to magnetically yet releasably attach the mount to the magnetically attractive mounting surface thereby securely and stably mounting the die cavity modifying machine thereto so its base will not move or slip during operation.

A slug retention groove forming machine constructed in accordance with the present invention preferably is portable, preferably weighing less than 10 pounds, enabling the machine to be transported and used to form a slug retention groove in a cavity of a die while the die is still mounted in its stamping press. Such a slug retention machine enables precise positioning of the machining insert, preferably rotary grinding bit, used to machine the slug retention groove by providing adjustability along a first axis in a direction toward or away from the die as well as adjustability along a second axis toward or away from the cavity of the die in a direction generally parallel to that of a die punch entering the die.

BRIEF DESCRIPTION OF THE DRAWINGS

The drawings illustrate at least one preferred embodiment presently contemplated for carrying out the invention. In the drawings.

Figure 1:
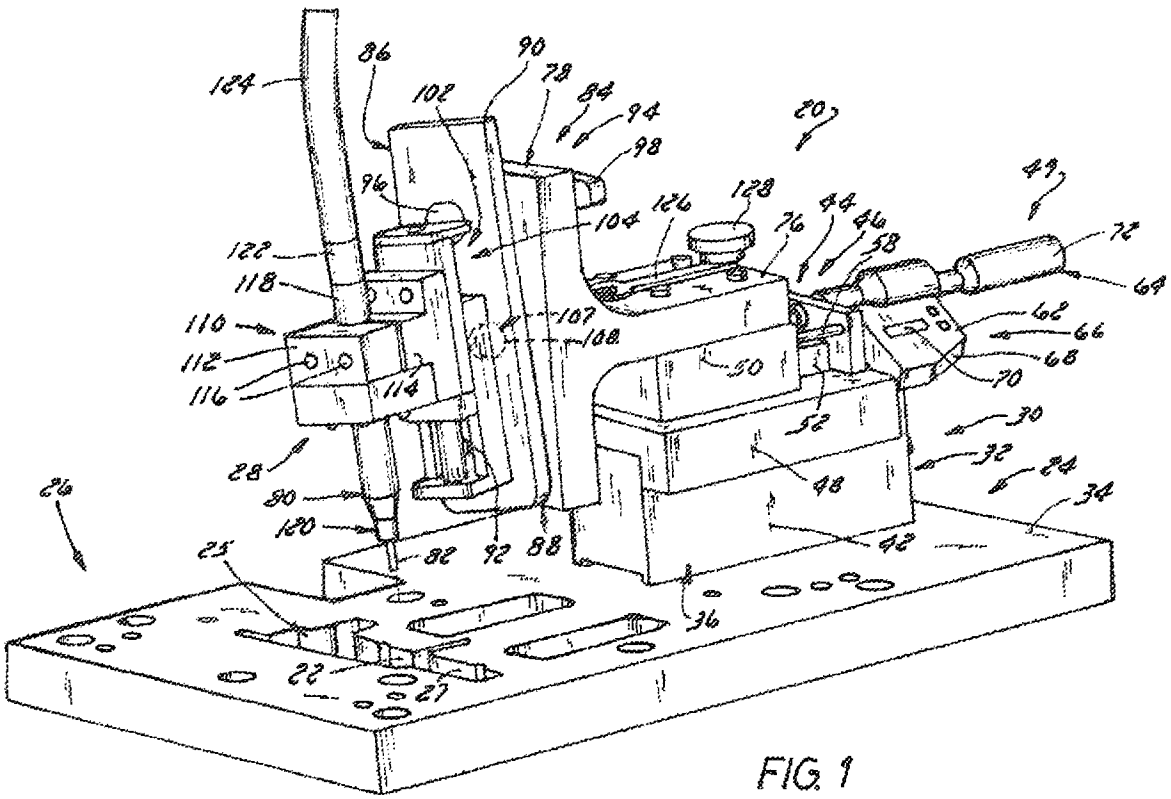
FIG. 1 is a front perspective view of a slug retention groove forming machine constructed in accordance with the present invention.

Before explaining embodiments of the invention in detail, it is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION

Figure 8:
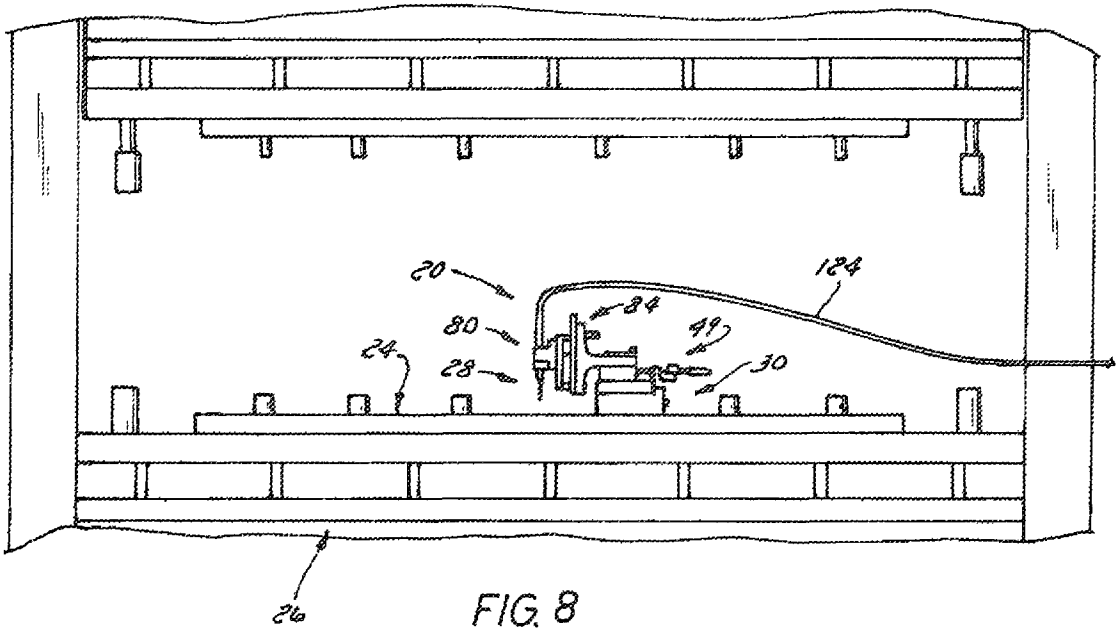
FIG. 8 illustrates use of the slug retention groove forming machine on a die already mounted in a stamping press showing the versatility of the machine as it is transportable and usable without having to remove the die from the stamping press.

FIGS. 1-7 illustrates a slug retention groove forming machine 20, also known as a slug keeper machine, constructed in accordance with the present invention used to modify a die cavity or die opening 25 of a die 24 in a manner that helps prevent pulling of blanks or slugs (not shown) created during operation of a stamping press 26 (shown in more detail in FIG. 8). In the preferred slug retention groove forming machine embodiment shown in FIGS. 1-7, the machine 20 is configured to machine one or more slug retention grooves 22 in a sidewall 27 that forms at least part of a die cavity or opening 25 that help prevent pulling of a slug created during operation of a stamping press 26. Both the die 24 and the stamping press 26 can be of conventional construction with the die 24 having one or more of a top die shoe, top thrust plate, punch holder plate or punch plate, punch, stripper backing plate stripper plate, die plate, die backing plate lower die shoe and/or guide pillar and brush.

A slug retention groove forming machine 20 constructed in accordance with the present invention is compact, lightweight and therefore advantageously transportable enabling the machine 20 to be used out in the field on a die 24 installed in a stamping press 26 without having to remove the die 24 from the stamping press 26. The machine 20 is advantageously adjustable along a plurality of axes enabling relatively precise adjustment of a machining head 28 of the machine 20 relative to a die 24 which is going to be modified by machining enabling the depth and angle of each slug retention groove 22 machined into a single die 24 to be precisely controlled.

The slug retention groove forming machine 20 has a base 30 offset from the machining head 28 enabling the machine 20 to stably rest upon the base 30 in a manner that desirably generally positions the machining head 28 relative to a die 24 that is going to be modified using the machine 20 to prevent slug pulling during stamping. The base 30 is constructed and arranged to enable the machine 20 to be stably anchored in place wherever the machine 20 is used. In the preferred slug retention groove forming machine 20 shown in the drawing figures, the base 30 includes a mount 32 configured for releasable mounting on a surface 34, e.g., a flat or generally planar surface, which can be an outer or top surface of a die 24 mounted in a stamping press 26 or a die resting on a work holding surface of a tool room (not shown) advantageously enabling a preferred embodiment of a slug retention groove forming machine 20 or the present invention to be portable or transportable such that it can be used nearly anywhere.

Figure 5:
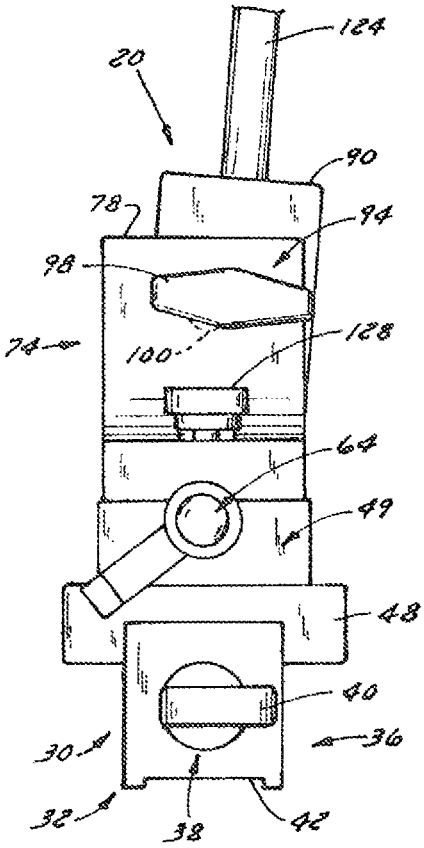
FIG. 5 is a rear elevation view of the slug retention groove forming machine.

In one embodiment, the mount 32 is a magnetic mount 36 configured for releasable mounting to a magnetically attractive mounting surface 34 that can be the outer or top surface of a die 24 mounted in a stamping press 26 or a magnetically attractive workholding surface, e.g., workbench or table, located in a tool room (not shown) where the die 24 is being prepared for use in a stamping press 26. Such a magnetic mount 36 can include an actuator 38, such as a lever or knob 40, used to magnetically yet releasably attach the mount 36 to the magnetically attractive mounting surface 34 securely and stably mounting the machine 20 thereto so its base 30 will not move or slip during operation.

Where the mount 32 is a magnetic mount 36, the magnetic mount 36 includes a source of magnetic flux (not shown) or magnetic field that emanates from at least a portion of the mount 36, which can be produced using one or more permanent magnets or by employing one or more electrically energized electromagnets. In one embodiment, one or more permanent magnets, such as one or more rare earth magnets, e.g., Alnico magnets, neodymium magnets, or the like, are disposed within an generally rectangular boxlike outer housing 42 of the magnetic mount 36 and movable relative to the housing 42 toward or away from the magnetically attractive mounting surface 34 in response to manipulation of the actuator 38. When the magnets of the magnetic mount 36 are moved toward the magnetically attractive outer surface 34, the magnets are positioned close enough to the surface 34 producing a strong enough magnetic attraction with the mounting surface 34 that immovably anchors the machine 20 in place to the surface 34. When the magnets of the magnetic mount 36 are moved far enough away from the mounting surface 34 that magnetic attraction with the surface 34 is minimized, the machine 20 can be grasped and lifted free of the mounting surface 34 enabling the machine 20 to be transported elsewhere.

Where the actuator 38 of the magnetic mount 36 is a knob 40, such as the knob 40 shown in FIG. 5, the knob 40 can be manually turned or rotated by a user of the machine 20 between a mounting position where the machine 20 is magnetically mounted to a magnetically attractive mounting surface 34 and a release position enabling the machine 20 to be lifted free of the surface 34 and moved to another location. Where the magnetic mount 36 uses one or more electromagnets, the knob 40 can function as a switch or operate a switch that selectively electrically energizes or de-energizes the electromagnets as needed to releasably yet immovably mount the machine 20 to the mounting surface 34.

The base 30 carries a first slide 44 used to move the machining head 28 along a first axis 45 that preferably is generally parallel to the mounting surface 24 and generally perpendicular or orthogonal relative to a die cavity 25 (FIG. 1) formed in the die 24 which the slug retention groove forming machine 20 is going to be used to modify to provide slug retention. In the preferred embodiment of the machine 20 shown in the thawing figures, the first slide 44 is a horizontal slide arrangement 46 carried by a base plate 48 that is attached to the mount 32, such as by one or more fasteners, e.g. bolts, or the like.

Figure 3A:
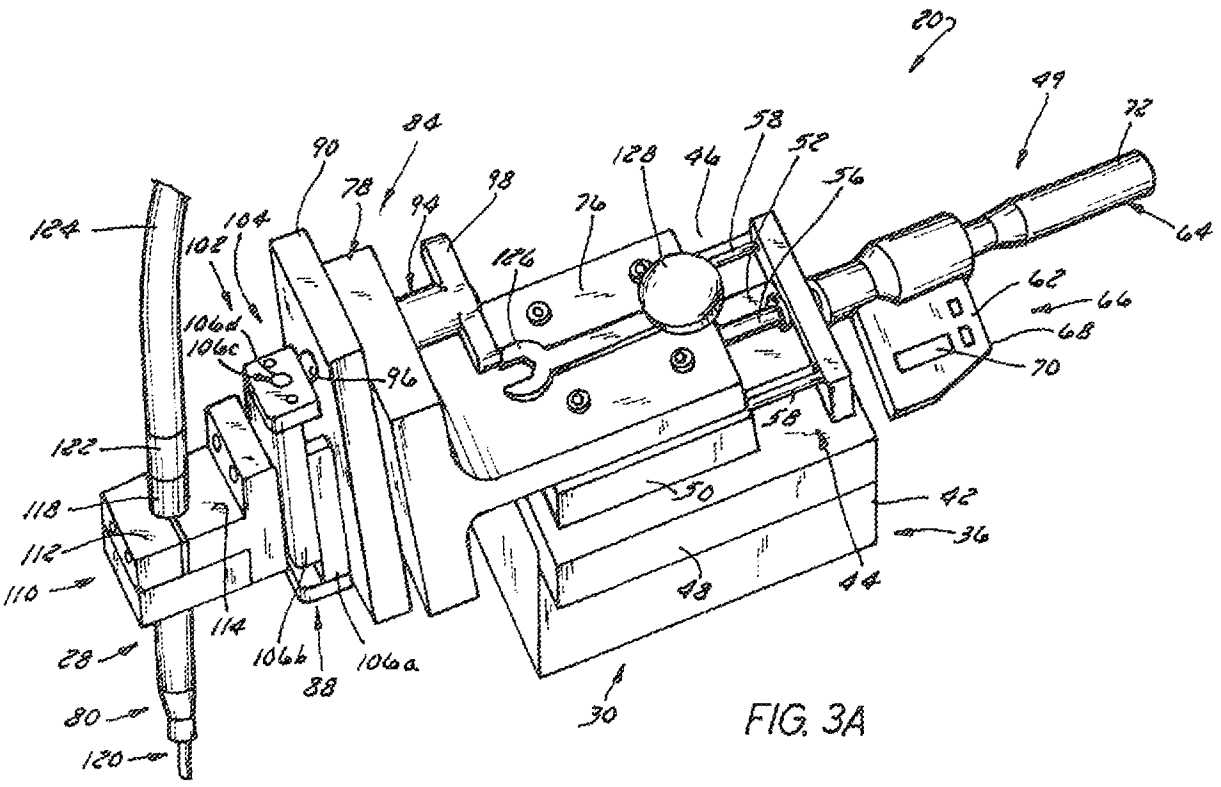
FIG. 3A-3B are top perspective views of slug retention groove forming machines.
Figure 6:
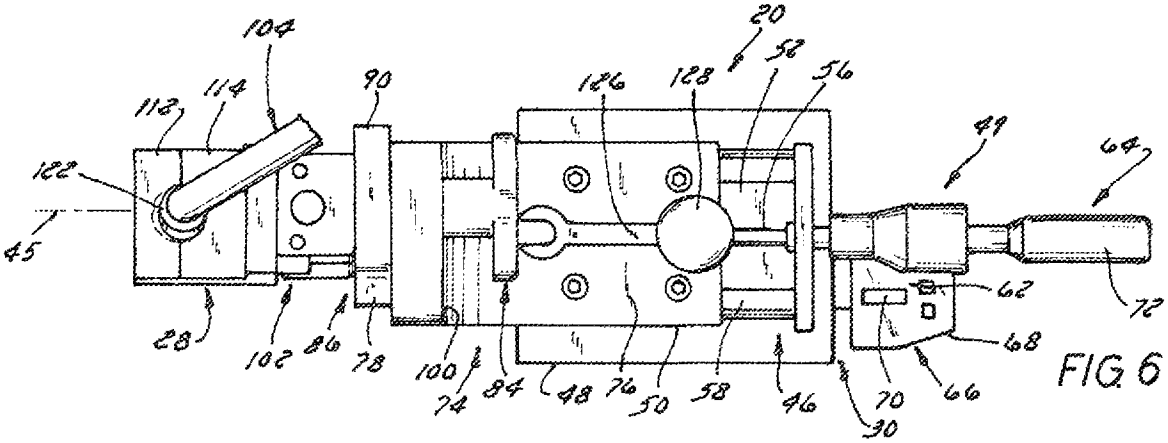
FIG. 6 is a top plan view of the slug retention groove forming machine.
Figure 7:
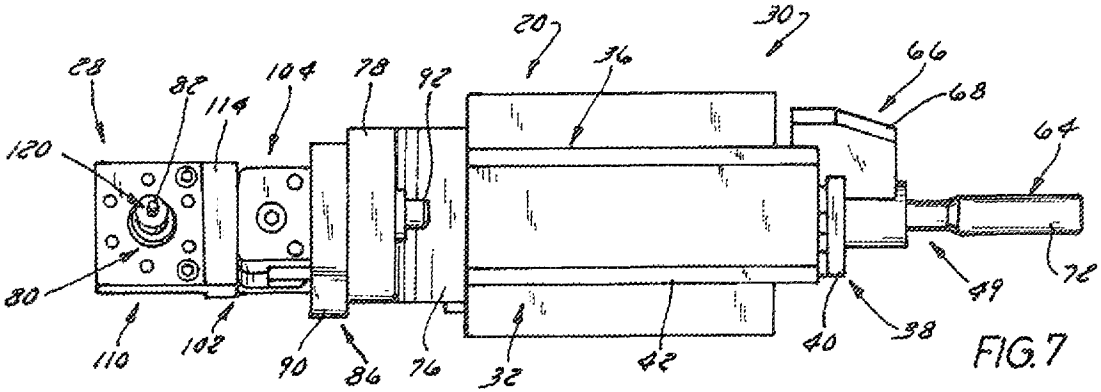
FIG. 7 is a bottom plan view of the slug retention groove forming machine.

With reference to FIGS. 3*a* and 6, the horizontal slide arrangement 46 includes a drive 49 that moves a slide plate 50 relative to the base 30 enabling the position of the machining head 28 to be moved generally horizontally relative to the base 30 after mounting the slug retention groove forming machine 20 to the mounting surface 34. The horizontal slide arrangement 46 also includes an anchor plate 52 fixed to the base 30, such as via one or more fasteners, e.g. bolts, or the like. The drive 49 cooperates with a slide plate stop 54 from which a drive piston or shaft 56 outwardly extends that is attached to the slide plate 50. The horizontal slide arrangement 46 includes a plurality of spaced apart guides 58, e.g., elongate guide rods slidably cooperate with the slide plate 50 to slidably guide horizontal movement of the slide plate 50 relative to the base 30, anchor plate 52, and slide plate stop 54.

The drive 49 includes a drive actuator 64 that operatively cooperates with the drive shaft 56 to cause horizontal movement of the slide plate 50 relative to the base 30, anchor plate 52, and slide plate stop 54 (and outer surface of a die 24 to which the machine 20 is releasable mounted). In a preferred horizontal slide arrangement 46, the drive 49 includes or cooperates with a position indicator 66, e.g., relative position indicator, such as in the form of a micrometer 68 having a digital display 70 capable of displaying relative horizontal slide movement to within 0.0001 inch accuracy enabling precise horizontal positioning of the machining head 28 to be done, in another preferred embodiment, the micrometer 68 enables display of relative horizontal slide movement to within 0.001 inch accuracy enabling slug retention groove depth to be precisely controlled. The micrometer 68 also includes one or more controls 62 that enable a position value to be reset and/or a relative position value to be set during positioning of the machining head 28 using the slide 44. In a preferred embodiment, the micrometer 68 is a micrometer modified to allow a shaft of the knob 72 to be operatively coupled to the drive shaft 56 while being able to measure movement of the slide plate 50 when the knob 72 is rotated. For example, the shaft of the knob 72 can be directly connected to the drive shaft 56 or indirectly coupled to the drive shaft 56 such as by gearing or the like.

In the preferred slug retention groove forming machine embodiment shown in the drawings, the drive actuator 64 includes a manipulable knob 72 that is rotated in one direction to cause the slide plate 50 to move generally horizontally relative to the base 30, anchor plate 52, and slide plate stop 54 in one direction and that is rotated in an opposite direction to cause the slide plate 50 to move generally horizontally relative to the base 30, anchor plate 52, and slide plate stop 54 in the opposite direction. Where a manipulable knob 72 is used, rotation of the knob 72 rotates the drive shaft 56 which in turn displaces the slide plate 50 relative to the shaft 56 causing the slide plate 50 to move relative to the base 30, anchor plate 52 and slide plate stop 54.

Where the drive 49 employs a rotary drive shaft 56, the shaft 56 can include or otherwise cooperate with a screw (not shown) disposed in engagement or operative cooperation with the slide plate 50 enabling relative rotation of the shaft 56 to displace the slide plate 50 relative to the shaft 56. Where a screw type drive arrangement is employed, it can be or otherwise include a ball screw or the like that translates rotation of the drive shaft 56 into relative movement of the slide plate 50 in positioning the machining head 28 generally horizontally relative to a desired die cavity 25 of the die 24 sought to be modified to provide slug retention.

The horizontally displaceable slide plate 50 of the horizontal slide arrangement 46 moves a machining head carriage 74 substantially in unison therewith. The carriage 74 includes a carriage mount 76 carried by the slide plate 50 and a machining head support 78 oriented generally perpendicularly or orthogonally relative to the direction of motion of the horizontal slide arrangement 46. As is shown in the drawing figures, the machining head support 78 extends generally vertically relative to the slide plate 50 with the carriage mount 76 extending generally outwardly from the machining head support 78 overlying at least a portion of the slide plate 50.

In the preferred slug retention groove forming machine embodiment shown in the drawing figures, the machining head carriage 74 is generally T-shaped with the carriage mount 76 extending generally horizontally outwardly from a generally vertically extending machining head support 78. As is best shown in FIGS. 1-3*a*, the carriage mount 76 is a generally rectangular plate that overlaps part of the slide plate 50 with the mount 76 attached to the slide plate 50 using a plurality of fasteners, e.g., bolts, or the like. The machining head support 78 is a generally rectangular plate extending generally perpendicularly or orthogonally to the carriage mount 76.

The machining head 28 is of adjustable construction being configured to adjustably position a tool 80 of the machining head 28 used to engage and modify the die 24 relative to the die 24. The machining head 28 is adjustably mounted to the carriage 74 in a manner that permits positioning of the tool 80 along a second axis 79 generally perpendicular or orthogonal to the first axis 45 enabling the tool 80 to be moved relative to the die 24 toward or away from the die 24. The machining head 28 can also be angularly adjustable enabling a machining bit 82 of the tool 80 to be oriented at an angle, α, relative to the first axis 79 to machine the die 24 at an angle during slug retention die modification.

Where the machining head 28 is angularly adjustable, an angular adjustment mechanism 84 is employed that includes a swivel assembly 86 in operative cooperation with the machining head support 78 that permits swiveling of at least part of the machining head 28 relative to the die 24 to orient the tool 80 at a desired angle, α, before machining the die 24 in performing slug retention modification of the die 24. The swivel assembly 86 includes a swivel 88 carrying the machining head 28 that is pivotally attached to the machining head support 78 and which can be releasably retained in the desired angular position once the desired angular orientation is set by a user.

As is shown in the drawing figures, the swivel 88 includes an elongate generally vertically extending swivel plate 90 pivotally attached by a pivot 92, e.g., pivot bolt, to the machining head support 78 at or adjacent one end of the swivel plate 90. The swivel plate 90 is releasably retained in a desired angular orientation by a swivel clamp 94 that includes an angle adjustment post 96 extending from the swivel plate 90 that is threadably engaged with a clamping knob 98 and tides in an elongate angle adjustment slot 100 (FIG. 5) formed in the machining head support 78 that can be curved, e.g., arcuate. Although not shown, the angle adjustment mechanism 84 can include a scale or indicator that helps a user of the machine 20 to accurately visually set the angle of the machining insert 82.

While the angle adjustment slot 100 is formed in the machining head support 78, the slot 100 can also be formed in the swivel plate 90 if desired. While the pivot 92 is disposed below the slot 100, it is contemplated that the swivel assembly 86 can be oriented differently, such as by being oriented oppositely with the pivot 92 disposed above the slot 100 such that a modified swivel assembly would be oriented upside down from that shown in the drawing figures.

A second slide 102 carries the machining head 28 enabling movement of the head 28 relative to the die 24 in a direction toward or away from the die 24. In the preferred slug retention groove forming machine embodiment shown in the drawing figures, the second slide 102 enables the machining head 28 is be moved along, a second axis 79 that is generally perpendicular to the first axis 45 along which the first slide 44 allows machining head movement. In a preferred embodiment, the second axis 79 is generally parallel to the direction a punching die would travel in stamping a slug from a sheet of metal on the die 24 being stamped in the stamping press 26.

Figure 2:
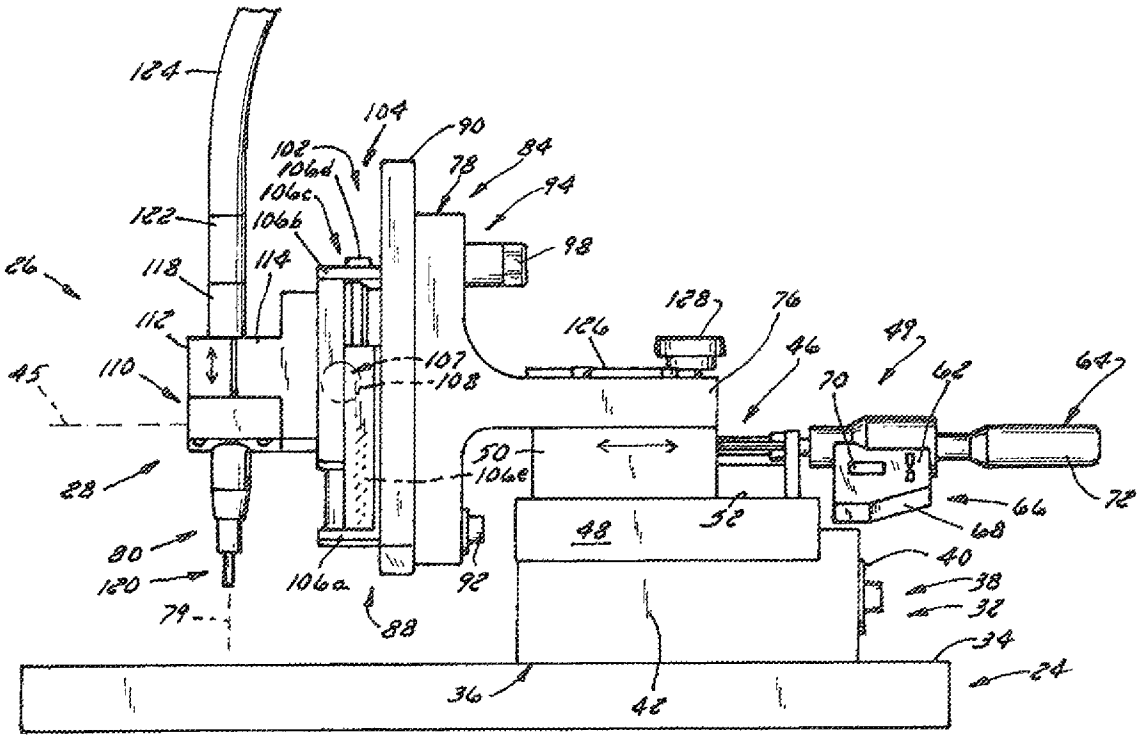
FIG. 2 is a side elevation view of the slug retention groove forming machine.

In the preferred embodiment shown in the drawing figures, the second slide 102 is a vertical slide arrangement 104 that includes a slide block arrangement shown in FIGS. 2 and 3*a* as including a lower slide block 106*a* attached to the swivel plate 90 and an upper slide block 106*b* arranged for longitudinal movement with respect to the lower slide block 106*a* and being operably connected to the machining head 28. This allows the machining head 28 to be movable toward and away from the die 24. Referring now to FIG. 2, a damper arrangement 106*c* may be arranged within the second slide 102 for controlling ease of relative movement between the upper and lower slide blocks 106*a*, 106*b*. The damper arrangement 106*c* may include an adjustment screw 106*d* that can be rotated to establish relatively more or less resistance to movement between the upper and lower slide blocks 106*a*, 106*b*. A spring 106*e* may be arranged within the damper arrangement 106*c* to bias the upper slide block 106*a* toward a neutral or upper position relative to the lower slide block 106*b*, for example, in the return spring—type manner. The spring 106*e* may damp or otherwise isolate the machining head 28 from vibrations transmitted through other components of the machine 20. Rotating the adjustment screw 106*d* may adjust the preload or other characteristic of the spring 106*e* so as to influence the movement resistance between, including optionally locking, the upper and lower slide blocks 106*a*, 106*b*.

Figure 3B:
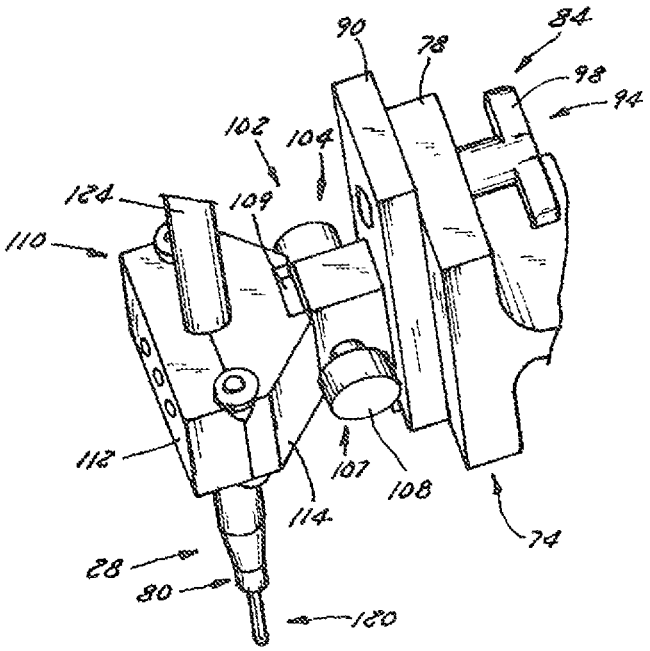

Referring again to FIGS. 1 and 2, movement of the machining head 28 by way of the vertical slide arrangement 104 may be done by directly grasping and manipulating the machining head 28 or by way of a height adjusting arrangement 107. The height adjusting arrangement 107 may include a position adjustment knob 108 that can be rotated to move the upper and lower slide blocks 106*a*, 106*b* (FIG. 2) with respect to each other and correspondingly move the machining head 28 close closer to or further from the die 24. Referring now to FIG. 3*b*, in this embodiment, instead of upper and lower slide blocks 106*a*, 106*b*, the vertical slide 104 includes a slide block 106 extending outwardly from the swivel plate 90 that carries the machining head 28. The knob 108 of the height adjusting arrangement 107 extends outwardly from the slide block 106 that rotates a gear or toothed shaft (not shown) disposed within the block 106 that engages an elongate linear gear or toothed rack 109 that vertically displaces the head 28 relative toward or away from the die 24. The rack 109 is mounted to the head 28 or otherwise cooperates with the head 28 in a manner that enables the head 28 to be raised or lowered by turning the position adjustment knob 108.

The machining head 28 includes a tool clamping assembly 110 having a pair of clamping blocks 112 and 114 attached by fasteners 116, such as bolts, which can be loosened, such as by using a wrench, e.g., hex head wrench, to change the position of the tool 80 and its machining bit 82 relative to the clamping assembly 110 along with the rest of the machine 20 enabling the position of the insert 82 to be further adjusted relative to the die 24. Once a desired general position relative to the clamping blocks 112 and 114 has been set, the fasteners 116 are tightened to clamp the blocks 112 and 114 around a housing 118 of the tool 80 securely holding the tool 80 in place. This advantageously enables the general position of the tool 80 and machining insert 82 relative to the die being modified to be generally set before using the machine 20 to actually modify the die to provide slug retention.

As best shown in FIG. 6, each clamping block 112 and 114 has an elongate and arcuate channel of hemispherical contour or cross section in which a corresponding portion, e.g., half, of the tool housing 118 is received and engaged, represented in dashed-lines extending around the tool housing 118. As the fasteners 116 are tightened, it increases clamping pressure and friction applied to the tool housing 118 to immovably lock the tool 80 in place. The clamping assembly 110 advantageously enables relatively rough pre-positioning of the machining head 28, tool 80 and insert 82 relative to the die cavity being, modified before liner position adjustments are subsequently made as described below, which can be made in preparation for slug retention groove forming machine operation as well as during slug retention groove forming machine operation.

In the preferred embodiment of the slug retention slug retention groove forming machine 20 shown in the drawings, the tool 80 is a grinder, such as a fluid powered grinder, which preferably is an air or pneumatic grinder capable of rotating the machining insert 82 at rotational speeds of between zero revolutions per minute and up to 70,000 revolutions per minute during slug retention die modification. The grinder 80 has a generally cylindrical and elongate housing 118 with the machining insert 82 extending outwardly from a chuck or collet 120 at one end and a control 122 at its opposite end adjacent an air hose 124 that supplies motive power to the grinder 80.

Where the grinder 80 is an air grinder, the control 122 can be a generally cylindrical rotary control carried by the housing 118 that is manually turned in one direction to increase the rotary speed of the machining insert 82 and manually turned in an opposite direction to reduce the rotary speed of the insert 82, including to stop rotation of the insert 82 when desired. Where the grinder 80 is an air grinder, the grinder speed control 122 preferably controls the flow of pressurized or compressed air from the hose 124 into and through a motor (not shown) within the grinder housing 118 that rotates the insert 82.

The collet 120 releasably retains the machining insert 82 in a manner that enables removal and replacement of the insert 82 when needed. One or more wrenches 126 releasably mounted using a knob 128 to part of the carriage mount 76 can be removed and used to engage the collet 120 to remove and replace the insert 82. In the preferred embodiment shown in the drawing figures, the wrench retention knob 128 can either be suitably loosed or disengaged from the carriage mount 76 to enable a pair of wrenches 126 to be removed to be used to engage the collet 120 to change the insert 82.

In a preferred embodiment, the air grinder 80 is a pencil grinder or micro-air grinder having an elongate generally cylindrical housing 118, e.g., handle, which has a generally circular cross section or O.D. that is substantially constant along its length enabling the grinder 80 to be clamped in the clamping assembly 110 nearly anywhere along the length of the housing 118. In one preferred embodiment, the air grinder 80 is a Jet (e.g., Jet JSM-516N), Sioux (e.g., Sioux 5979A), Klatch or Neiko Micro or Pencil Air Grinder having a length of about four to five inches capable of rotating the insert 82 to rotational speeds as fast as 55,000 revolutions per minute. Such an air grinder 80 has a generally cylindrical housing 118 between about two inches and about five inches long, enabling the grinder 80 to be clamped substantially anywhere along the length of its housing 118 providing at least two inches and no more than five inches of adjustment generally in the direction of the second axis 79 prior to performing any further or finer adjustment along the same axis using the vertical slide 104. This enables the end or tip of the insert 82 to be pre-positioned relative to the die 24 using the clamping assembly 110 before more finely positioning the end or tip of the insert 82 relative to the die 24 using the horizontal and vertical slides 46 and 104. This enables, for example, macro-positioning of the insert 82 generally in the vertical direction relative to the die 24 before performing finer adjustment in the vertical direction (i.e., generally along axis 79) using the vertical slide 104 and/or the horizontal direction (i.e., generally along axis 45) using the horizontal slide 46.

In a preferred embodiment, the machining insert 82 is a generally cylindrical grinding bit capable of forming a recess, preferably an elongate groove, in part of a die cavity defining sidewall 27 of the die 24. The machining insert 82 preferably is an elongate generally cylindrical grinding bit that can be a burr-type die grinding bit such as a carbide burr pointed cone die grinding bit, a carbide burr pointed tree shaped die grinding bit, a carbide burr nose tree shaped die grinding bit, a carbide burr cylinder die grinding bit, a carbide burr ball shaped bit, or another suitable burr-type grinding bit. Of course, other types of bits and cutting inserts can be used including an insert 82 having a grinding wheel tip or the like.

Where the die is modified to form a slug retention groove 22 using the machine 20, such a groove is elongate but relatively shallow having a length extending from at or adjacent the outer surface of the die to below the depth the punch of the stamping presses reaches during stamping of the blank or slug during stamping press operation. The groove that is machined can be straight or helical depending on the contour or configuration of the die cavity. Such a groove can be machined in accordance with that disclosed in U.S. Pat. No. 4,543,865, the entirety of which is expressly incorporated herein by reference. Such a groove formed by the machining insert 82 using the machine 20 can be machined to conform to the specifications and characteristics disclosed in U.S. Pat. No. 4,543,865, but which preferably is substantially straight instead of being helical or spiral.

In use and operation, the tool 80 of the slug retention groove forming machine 20 is positioned on a surface, such as the outer or top surface or a die, e.g., die 24, where it is readied for use in modifying the die to improve slug retention by machining part of the die in or along a die cavity sidewall 27. In a preferred method of use, the machine 20 is initially roughly pre-positioned and then more finely adjusted in order to machine part of a die cavity sidewall 27 in a manner that prevents slugs from being pulled out of the die cavity during stamping press operation.

Figure 9:
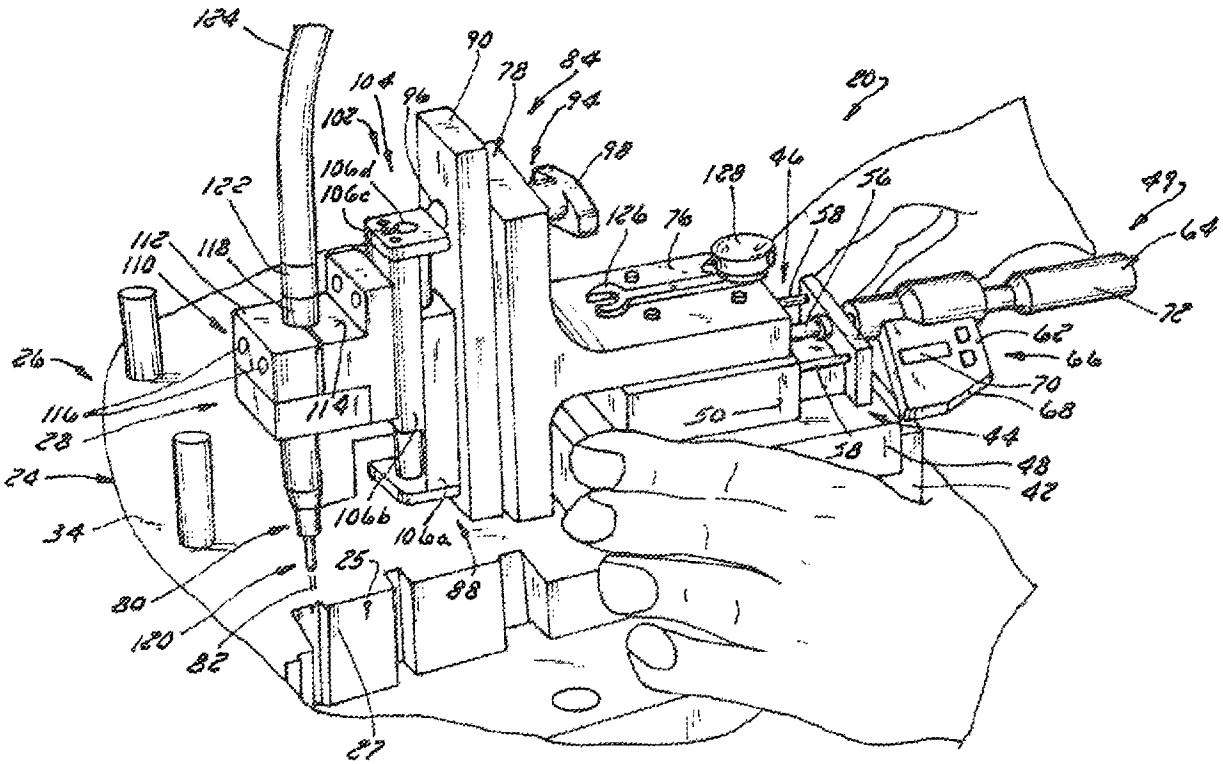
FIG. 9 illustrates initial positioning of the machine on the die within a stamping press.

The tool 80 can be positioned to better locate the machining insert 82 relative to a die, e.g. die 24, being modified by the slug retention groove forming machine 20 by adjusting the position of the tool 80 in the head 28 using the clamping assembly 110. With reference to FIG. 9, an Allen wrench is used to loosen the fasteners 116 connecting the clamp blocks 112 and 114 releasing pressure applied by the blocks 112 and 114 to the housing 118 of the tool 80 enabling the housing 118 to be manually grasped to raise or lower the tool 80 and its insert 82. Once a desired relative machining insert height is set, the Allen wrench is used to tighten the fasteners causing the clamping blocks 112 and 114 to once again clamp tightly around the tool 80 releasably locking it in place. This increased height adjustability advantageously enables the machine 20 to be used to lower the tool 80 and insert 82 enabling the machine 20 to be used to modify a die 24 in a stamping press while the machine 20 is resting on the die 24 as well as to raise the tool 80 and insert 82 enabling the machine 20 to be used to modify a die insert mounted on a surface grinder magnet in a tool room.

FIG. 9 illustrates a pair of wrenches 126 (only one representatively shown) that may be removed from the carriage mount 76 to engage the collet 120 to remove the machining insert 82, in this case a grinding bit, so it can be replaced. Both wrenches 126 are used to engage different portions of the collet at the same time to loosen the collet 120 enabling the insert 82 to be removed. After removal, another insert 82 is inserted into the collet 120 before the wrenches 126 are used to re-tighten the collet 120 securing the insert 82 to the collet. The collet 120 can also be loosened to extend or retract the insert 82 relative to the collet 120 and the housing 118 of the tool 80 to change the height of the tip or end of the insert 82 relative to a die or die insert that is going to be modified by the machine 20 to provide slug retention.

FIG. 8 illustrates use of the slug retention groove forming machine 20 in a stamping press 26 with the base 30 of the press resting on the top or outer surface of the die 24 sought to be modified using the machine 20. FIG. 8 also shows a compressed air hose 124 connected to the tool 80 clamped in the head 28 of the machine 20. By being small enough to be used within a stamping press 26, the slug retention groove forming machine 20 advantageously saves time as it allows one or more die cavities formed in the die 24 to be modified using the machine 20 to subsequently provide slug retention when the press 26 is returned to operation. This advantageously enables the die 24 to be modified to provide slug retention without having to pull the die 24 out of the stamping press 26 and taking it to the tool room. This not only saves time and returns the stamping press 26 back to operation faster, it also advantageously enables the slug retention groove forming machine 20 to be used nearly anywhere, on a die in a stamping press, in the tool room on a die being serviced, on a new die before being installed in a stamping press, on takeover dies, as well as on dies that would ordinarily never run without pulling slugs.

FIG. 9 illustrates use of the slug retention groove forming machine 20 being used on a die 24 installed in a stamping press 26 (FIG. 8). In preparation for use, the machine 20 is placed in the die 24 with its base 30 resting on the outer surface of the die 24. The base 30 of the machine 20 is manually positioned so it is generally perpendicular to an upper edge of a cavity sidewall 27 of the die 24 that defines a die cavity 25 being modified to provide slug retention. The machine 20 is manually positioned so that its machining insert 82 is located adjacent an upper edge of the die cavity sidewall 27 of the die 24 so that the insert 82 will travel alongside part of the cavity sidewall 27 so that it brushes or touches the sidewall 27 when the tip or end of the insert 82 is lowered into the die cavity. Once this pre-positioning step has been done, the magnetic mount 36 is activated to magnetically mount the base 30 of the machine 20 securely in place on the die 24 so it will not move relative to the die 24 during machining of the die 24 to modify the die 24 to provide slug retention.

With reference again to FIG. 1, a vertical position of the machining head 28 relative to the die 24 may be adjusted by grasping and manually moving the machining head 28 and/or by rotating the adjustment knob 108 to make sure that the tip or end of the machining insert 82 will pass below the land on the die 24 or die block being modified to provide slug retention. In one preferred method implementation, the machining head 28 is moved to make sure that the tip or end of the machining insert 82 can be extended at least one quarter inch below the outer or top surface of the die 24 or die block. If it cannot be done, the clamping assembly 110 is loosened and the tool 80 is vertically repositioned relative to the clamping assembly 110 to provide the desired amount of machining insert depth in the die cavity.

After that, the tool 80 can be powered to cause the machining insert 82 to rotate. Where the tool 80 is an air grinder, the tool 80 is powered by supplying it with compressed air and by turning the air grinder control 122 to an operating position here compressed air causes the insert 82, in this case a grinding bit, to rotate.

Figure 14:
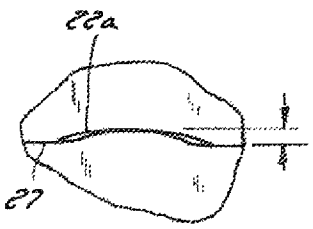
FIG. 14 is an enlarged view of a portion of the die cavity sidewall of the die cavity of FIG. 13D.

With continued reference to FIG. 1, the horizontal slide 46 is manually adjusted by rotating the horizontal position adjustment knob 72 to better position the machining insert 82 relative to an adjacent portion of the die cavity sidewall 27 so that vertical movement of the insert 82 will cause at least a slight groove to be formed in the die cavity sidewall 27. Once the slight groove is seen in the die cavity sidewall 27, the micrometer 68 is turned on and set to zero as depicted in FIG. 14.

With continued reference to FIG. 1 once again, the machining head 28 may be moved up and down by grasping and manually moving the machining head 28 and/or by rotating the knob 108 of the vertical slide 104 to move the machining insert 82 up-and-down to cause the slug retention groove 22 to be machined, in the die cavity sidewall 27 while the knob 72 of the horizontal slide 46 is turned to move the machining insert 82 towards the die cavity sidewall 27 to increase the depth of the groove 22 being machined by the rotating insert 82.

To control the depth of the groove being, machined by the rotating insert 82, the digital display of the micrometer 68 is monitored by a user of the machine 20. In a preferred implementation, a recommended depth of the groove being machined in the die using the rotating insert 82 is about 3% of stamping sheet thickness. To achieve such a depth, the knob 72 of the horizontal slide is rotated after zero setting the micrometer 68 when the insert 82 is initially brushing or contacting the die cavity sidewall 27. The knob 108 of the vertical slide 104 is rotated to the move the rotating insert 82 up-and-down to further machine the groove in the die cavity sidewall 27 each time the knob 72 of the horizontal slide 46 is rotated. This process is repeated while monitoring the display of the micrometer 68 until a groove depth of the slug retention groove being machined is achieved that is no more than about 5% of stamping sheet thickness and preferably about 3% of stamping sheet thickness.

Figure 4:
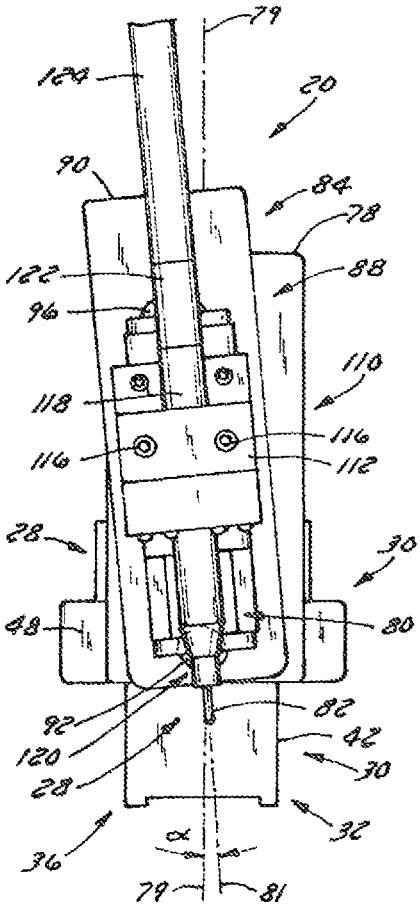
FIG. 4 is a front elevation view of the slug retention groove forming machine.

With reference to FIGS. 1 and 4, the angle of the rotational or cutting axis 81 (FIG. 4) of the insert 82 can be varied by adjusting the angle of the tool 80 relative to the vertical axis 79 by an angle, $\alpha$, which can vary between 0° and 15° which typically can be varied between 0° and no more than about 5° from the vertical axis 79. To adjust the angle of the tool 80 to change the rotational or cutting axis 81, the swivel clamping knob 98 is manually loosened to loosen the swivel plate 90 carrying the tool 80. The swivel plate 90 or head 28 is manually grasped and tilted to orient the angle of the longitudinal axis 81 of the insert 82 at the desired angle, $\alpha$, relative to the vertical axis 79 before the knob 98 is manually tightened to secure the head 28 carrying the tool 80 along with its insert 82 in place locking it at the desired angle. In the preferred embodiment shown in the drawing figures, the swivel assembly is constructed to enable angular adjustment of the insert 82 within ±5° of the vertical axis 79 (FIG. 4).

Figure 10:
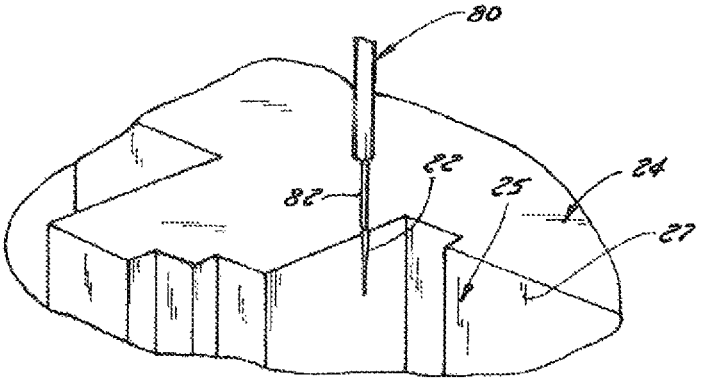
FIG. 10 illustrates a slug retention groove machined into the die cavity sidewall using a machining insert of the slug retention groove forming machine that is a grinding bit modifying the die cavity to provide slug retention.

FIG. 10 is illustrates an elongate slug retention groove 22 machined in a die cavity defining sidewall 27 of a die cavity 25 of a die 24 while the machine 20 is secured to the top or upper surface of the die 24 in a stamping press 26 as illustrated in previous drawing figures. The slug retention groove 22 is disposed at an angle that is substantially the same as the angle, $\alpha$, of the rotational axis 81 of the machining insert 82 relative to a vertical axis 79 that substantially corresponds to the axis of vertical movement of a punch (not shown) that is received in the die cavity 25 formed by the die cavity sidewall 27 of the die 24 machined with at least one groove 22 to provide slug retention. The slug retention groove 22 is disposed at an acute angle relative to the vertical axis 79 that preferably is no more than about 5° relative to the axis 79.

As is also shown in FIG. 10, the machining insert 82 is an elongate and generally cylindrical die grinding bit having a grinding surface disposed at or adjacent its free end that forms the slug retention groove 22 by abrading away part of the die cavity sidewall 27 when the machining head 28 is moved up and down by rotating the vertical slide knob 108. As previously discussed, the horizontal slide position adjustment knob 72 is turned as needed while monitoring the display of the micrometer 68 in order to control the depth of the groove 22 machined by the rotating insert 82.

During operation, machining head 28 may be moved up and down by grasping and manually moving the machining head 28 and/or by rotating the vertical slide knob 108 one or more times to raise and lower the rotating insert 82 into the die cavity causing the insert 82 to at least begin machining the slug retention groove 22 at the point where the micrometer 68 is set to zero. Thereafter, the horizontal slide position adjustment knob 72 is turned very slightly before the vertical slide position adjustment knob 108 is once again rotated to deepen the depth of the groove 22. This process is repeated while monitoring the micrometer 68 until the desired groove depth is achieved.

Figure 11:
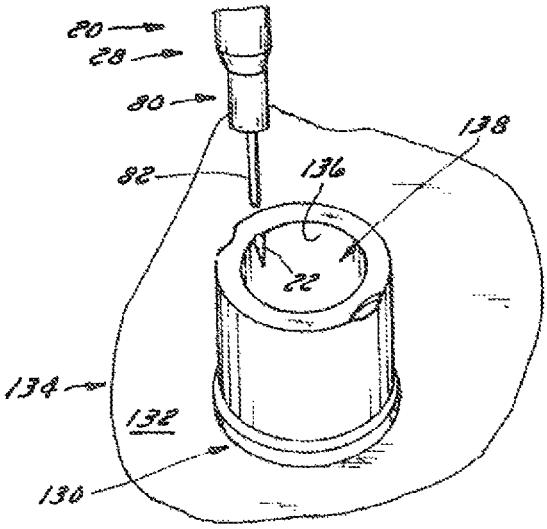
FIG. 11 illustrates use and operation of the slug retention groove forming machine to machine another slug retention groove in a die cavity sidewall of a die cavity of a die insert being modified in a tool room.
Figure 17:
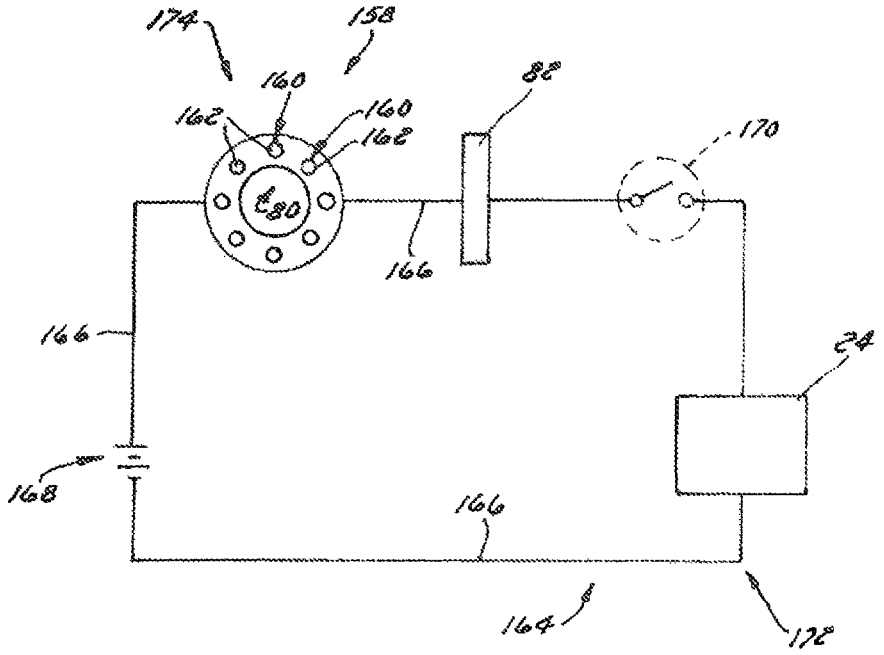
FIG. 17 is a simplified schematic representation of the contact detecting system of FIG. 16.

With reference to FIG. 11, the slug retention groove forming machine 20 can also be used to machine one or more slug retention grooves 22 in a die insert 130, such as the generally cylindrical or circular die insert 130 shown in FIG. 17, by securing, the die insert 130 on a flat surface 132 adjacent the machine 20. A magnetic base or workbench 134 can be employed to hold the insert 130 in place while the above-recited steps are carried out to position the head 28 and hence the groove-machining insert 82 relative to an inner die cavity defining sidewall 136 of the die cavity 138 so that rotation of the groove-machining insert 82 will form a slug retention groove 22 in the inner sidewall 136 of the die insert 130. After the machine 20 has been used to modify the die insert 130 to provide improved or increased slug retention, the die insert 130 can be removed from the tool room and installed or re-installed in a die or stamping press.

Once again, the machine 20, head 28 and groove-machining insert 82 are initially pre-positioned (1) so that the groove-machining insert 82 generally brushes against a top portion of the die cavity sidewall 136, and (2) so that the groove-machining insert 82 travels downwardly into the die cavity 138 far enough to produce a slug retention groove 22 that is long enough. In one preferred method implementation, the machine 20 is setup so that the groove-machining insert 82 will travel downwardly into the die cavity 138 at least as far as the thickness of the sheet that is going to be stamped using the die insert 130. The angle, $\alpha$, (FIG. 4) of the insert 82 is set relative to the vertical axis 79 is set and the micrometer zeroed. Thereafter, the tool 80 is powered to cause the groove-machining insert 82 to rotate before the rotating insert 82 is lowered into the die cavity and subsequently raised as needed by grasping and manually moving the machining head 28 and/or by using the vertical slide knob 108 until a slug retention groove 22 begins forming in the inner die cavity defining sidewall of the die insert. The micrometer 68 is monitored as the horizontal slide knob 72 is turned advancing the insert 82 toward the inner die cavity defining sideman deepening the depth of the slug retention groove being machined by the insert 82. These method steps are repeated as needed until the slug retention groove forming machine 20 of the invention has machined the slug retention groove 22 having a desired length and depth in the inner die cavity defining sidewall of the die insert. The die insert 130 can be rotated and the above method repeated to machine additional slug retention grooves 22 in the inner die cavity defining sidewall 136 of the die insert 130 as needed. When finished, the slug retention groove modified die insert 130 is installed or re-installed in a die or stamping press ready for stamping press operation.

Figure 15:
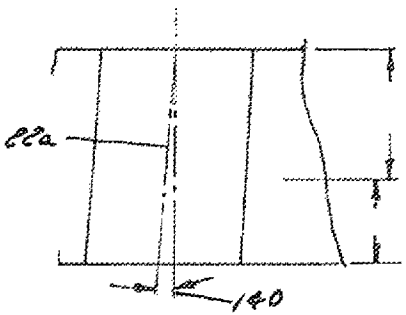
FIG. 15 is an enlarged fragmentary elevation view of a portion of the die cavity sidewall of FIG. 13D illustrating the acute angle and length of the elongate slug retention groove machined into the die cavity sidewall using a slug retention groove forming machine constructed in accordance with the present invention.
Figure 12:
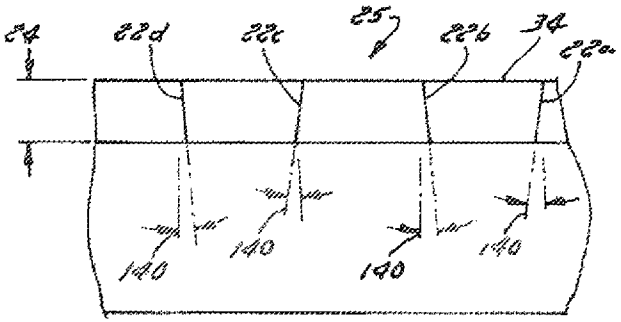
FIG. 12 is a fragmentary elevation view of a portion of a die cavity sidewall having a plurality of spaced apart acutely angled slug retention grooves machined into the sidewall using the slug retention groove forming machine shown in FIGS. 1-17.

In practicing the above method of modifying a die cavity in a manner that keeps slugs from pulling from a die during stamping press operation, a slug retention groove forming machine 20 constructed in accordance with the present invention is used to machine a plurality of spaced apart slug retention grooves 22*a*, 22*b*, 22*e*, and 22*d*, in a cavity sidewall 27 of a die cavity or die opening 25 as shown in FIG. 12. Each groove 22*a*, 22*b*, 22*c* and 22*d* is elongate, substantially straight, and has a length that extends at least to the die land shown in FIG. 12 and preferably at least somewhat just past the die land as shown in FIG. 15. For example, in one preferred method, the length of each groove 22*a*-22*d* extends at least one millimeter beyond the die land. Each groove 22*a*-22*d* preferably has a length that extends from the die cavity mouth at the top surface 34 of the die 24 to beyond the die land as shown in FIG. 12.

Each groove 22*a*-22*d* is machined at an acute angle relative to the direction of the punch entering the die, which corresponds to a vertical axis 140 in FIG. 12. As is shown in FIG. 12, the grooves 22*a*-22*d* can be equidistantly spaced apart such that the leading edge of each groove 22*a*-22*d* originating at or adjacent the die surface 34 (mouth of the die cavity) has substantially equal spacing between adjacent pairs of grooves 22*a*-22*d*. In a preferred slug retention method, at least a plurality of slug retention grooves 22*a*-22*b* is machined into the cavity sidewall 27 using the slug retention groove forming machine 20. In another preferred implementation of a slug retention method according to the present invention, a plurality of pairs of slug retention grooves 22*a*-22*c* or 22*b*-22*d* (i.e. at least three slug retention grooves) are machined into the die cavity sidewall 27. In another preferred method implementation, to or four grooves 22*a*-22*d* are equidistantly spaced apart and machined into the die cavity sidewall 27 for a given die cavity or die opening 25.

With continued reference to FIG. 12, each adjacent pair of grooves 22*a*-22*b*, 22*b*-22*c*, and 22*c*-22*d* is oppositely acutely angled relative to the vertical axis 140 with every other groove alternately acutely angled relative to the adjacent groove. In the exemplary die cavity sidewall shown in FIG. 12, each slug retention groove has an angle of between 3° and 5° relative to the vertical axis 140 with each adjacent pair of slug retention grooves 22*a* and 22*b*, 22*b* and 22*c*, and 72*c* and 22*d* being oppositely acutely angled at substantially the same acute angle. Machining a plurality of slug retention grooves into the cavity sidewall 27 of a die cavity or die opening 25 advantageously helps keep a slug punched during stamping in the die cavity or die opening 25 so it gets pushed out the bottom end of the die cavity or die opening 25 preventing it from being pulled upwardly out of the die cavity or die opening 25 during stamping press operation.

FIGS. 13A-13H illustrates some exemplary die cavity or die opening configurations along with the placement or location of slug retention grooves, e.g., grooves 22*a*-22*d* (FIG. 12), that respectively correspond to numbers 1-4 shown in FIGS. 13A-13H. Each die cavity or die opening has either two acutely angled slug retention grooves machined into the die cavity sidewall that defines the die cavity or die opening.

Figure 13:
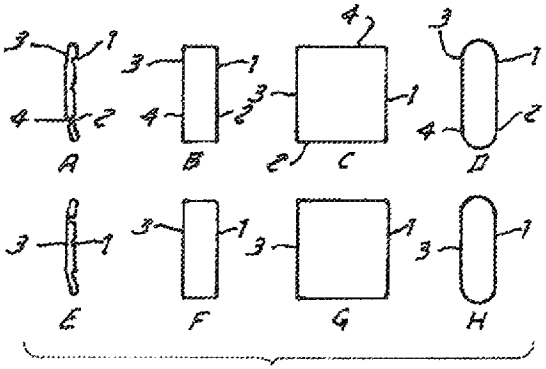
FIGS. 13A-13H illustrate four different die cavity opening shapes and slug retention groove spacing and placement for each die cavity opening shape.

FIG. 14 illustrates an enlarged top view of a slug retention groove 22*a* machined into part of the die cavity sidewall 27 of the oval or oblong die cavity shown in FIG. 13D. Wherever possible, it is always desirable to minimize the number of slug retention grooves machined into a die cavity sidewall in the part area so it is desired to machine as many slug retention grooves in non-part areas of the die cavity or die opening.

As is shown in FIG. 14, the groove 22*a* has a relatively shallow depth of no more than 5% of stamping sheet thickness and typically no more than about 3% of stamping sheet thickness. The grinding wheel tip diameter of the machining insert 82 of the slug retention groove forming machine 20 can be chosen based on stamping sheet thickness as is indicated in text in FIG. 14. In a preferred implementation, the grinding wheel tip of the machining insert 82 of the grinding tool 80 of the slug retention groove forming machine 20 has a diameter no more than 10% of stamping sheet thickness and preferably no more than about 5% of stamping sheet thickness.

Finally, a slug retention groove forming machine 20 constructed in accordance with the invention can also be used to machine an elongate groove in a stripper opening of a die that provides a vent groove shaped the same as the grooves 22 shown in the drawing discussed above that helps reduce suction when the punch is retracting from the die opening or die cavity during stamping press operation. Where the slug retention groove forming, machine 20 is used to machine one or more such vent grooves similar in length and depth as the slug retention grooves 22 shown in the drawing figures discussed above, each vent groove preferably is substantially straight and substantially parallel or coincident with the vertical axis 140 such that it is parallel to the axis along with the punch reciprocates during stamping press operation.

A slug retention groove forming machine 20 or "slug keeper" machine constructed in accordance with the present invention is advantageously versatile in that it is relatively small enabling it to be used to machine slug retention grooves 22 in die cavities or die openings of all shapes, sizes and lengths that can have irregularly shaped opening or cavity shapes or mouths (such as the irregularly shaped cavity/opening 25 of the die 24 shown in FIG. 1) as well as oblong, square, rectangular, circular, and cylindrical die cavity or die openings of varying lengths, widths and depths. A slug retention groove forming machine 20 constructed in accordance with the present invention is advantageously lightweight and compact having a weight less than ten pounds (about eight pounds) enabling a single person to move, setup and use virtually anywhere including on a die in a stamping press without having to first remove the die. Such a slug retention groove machining machine 20 is also advantageously versatile in that it can be used to machine vent grooves in a stripper opening of a die in a stamping press without having to first remove the die from the stamping press.

Figure 16:
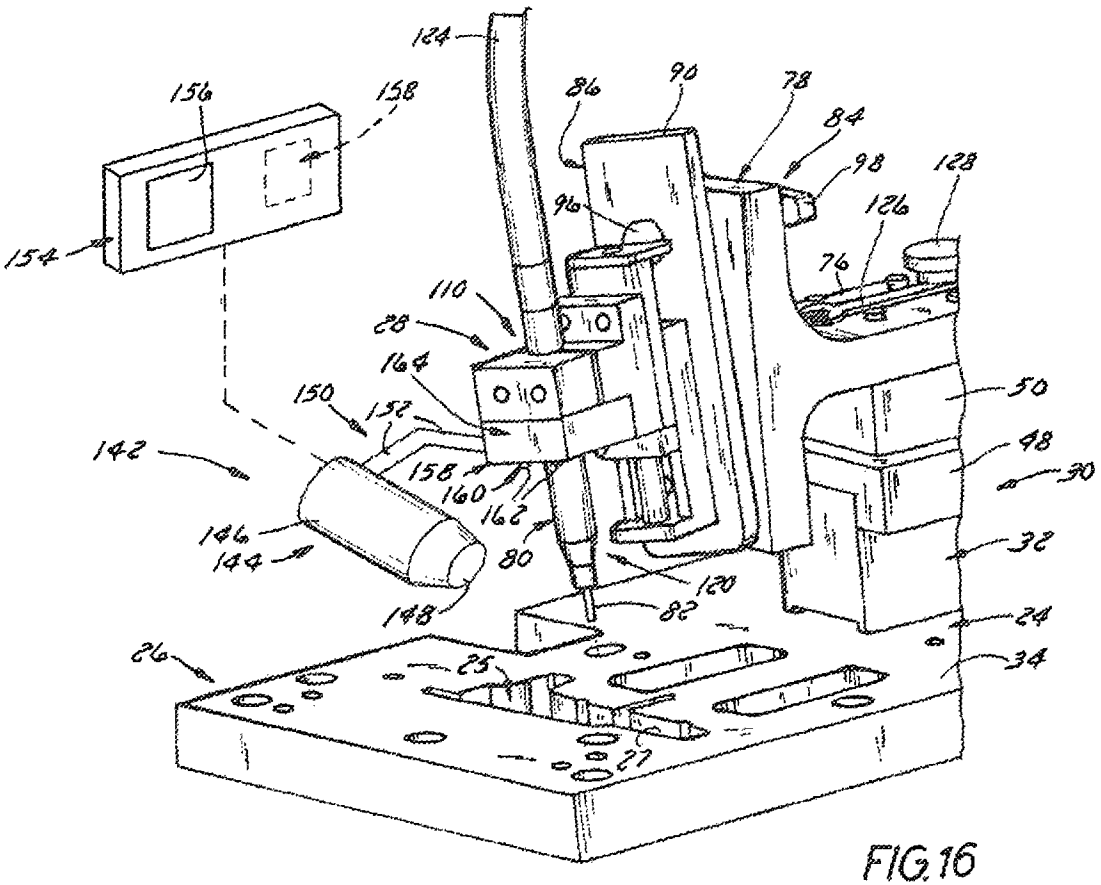
FIG. 16 is a front perspective view of a slug retention groove forming machine constructed in accordance with the present invention, including inspection, illumination, and contact detecting, systems.

Referring, now to FIG. 16 an inspection system 142 may be arranged with respect to the slug retention groove forming machine 20 for enhancing a user's view of the procedure(s) using the slug retention groove forming machine 20. Inspection system 142 includes an imaging or optical device 144 shown here is a camera 146 although it is understood that in another embodiment, the imaging device or optical device 144 may be a magnifying glass or other imaging/optical device 144. One preferred imagining or optical device 144 well suited for use in providing a user with an enhanced and/or enlarged image of the portion of the die cavity defining sidewall in which a slug retention groove is going to be machined (as well as during machining of the groove) is a digital microscope that can be a commercially available digital microscope.

The camera 146 includes a lens 148 that may be configured as a magnifying-type lens that is arranged to face toward the machining bit 82 for viewing the engagement of the machining bit 82 with the die 24. Camera 146 is supported by a support assembly 150 having multiple arms segments 152 that are arranged to articulate with respect to each other and that may be supported by the machine 20 so that the support assembly 150 can articulate with respect to the machine 24 moving the lens 148 to a desired position with respect to the machining bit 82. The camera 146 preferably is a digital camera, such as a digital camera of a digital microscope, which is operably connected to the display 154 which may be a display 154 of a computer, e.g., tablet, personal computer and/or laptop, and that includes a screen 156 that displays the view provided through the camera 146 and controls 154 manipulating views and/or settings of the camera 146 and/or the screen 156.

Still referring to FIG. 16, the machine 20 may include an illumination system 158 having at least one illumination device 160, shown here as bulbs 162 which may be light emitting diodes. Referring now to FIG. 17, the bulbs 162 may be spaced from each other and arranged concentrically around the tool 80 which may provide full illumination around the tool and the machining bit 82, without presenting shadows in any direction. Still referring to FIG. 17, a contact detecting system 164 may be arranged to detect and indicate an occurrence of the machining bit 82 contacting the die 24, both shown schematically in FIG. 17. The contact detecting system 164 may include conductors 166 such as wires or other electrical conducting arrangements that operably connect the machining bit 82 and die 24 to the power source 168 which may include a battery or other source of electrical energy. A contact switch 170, schematically represented as a dashed circle, may be defined by the machining bit 82 and die 24 that are arranged within a common circuit 172 so that the engagement or disengagement of the machining bit 82 and die 24 acts as a switch that closes or opens the circuit 172, respectively. Closing the circuit 172 during the engagement of the machining bit 82 and die 24 energizes a contact indicator 174 in a manner that is recognizable by the user of machine 20 (FIG. 1), allowing the user to recognize when the machining bit 82 first contacts the die 24. In this embodiment, the contact indicator 174 may be defined at least partially by the illumination system 158. Initial contact between the machining bit 82 and the die 24 causes the illumination device (s) 160 to illuminate. In one embodiment, some of the illumination device(s) 160 may be illuminated before initial contact between the machining bit 82 and the die 24 and when the machining bit 82 contacts the die 24 the remaining illumination device(s) 160 may illuminate so as to provide a visual indication to the user by way of a relatively brighter or more intense light from the illumination system 158 that the machining bit 82 has contacted the die 24.

The present invention therefore is directed to a machine 20 for modifying a die 24 to provide slug retention that includes a base 30, a carriage 74 adjustable along a first axis relative to a die 24, and a machining head 28 adjustable along a second axis relative to a cavity in the die 24. The carriage 74 is adjustable along a first axis that is generally perpendicular to the direction of a punch traveling into the cavity of the die 24 during stamping. The machining head 28 is adjustable along a second axis generally parallel to the direction of a punch traveling into the cavity of the die during stamping. The machining head 28 is adjustable along a second axis generally parallel to the direction of a punch traveling into the cavity of the die during stamping preferably by adjusting or enabling adjustment of the position of the head 28 relative to the die 24 and/or the die cavity 25. The machining head 28 is angularly adjustable to adjust the angle of the machining insert 82 relative to the second axis and die punch travel direction. The machining head 28 is angularly adjustable to adjust the angle of the machining insert 82 relative to the second axis and die punch travel direction thereby enabling adjustment of the angle of a slug retention groove 22 formed in a die cavity 25 defining sidewall 27 relative to the die cavity defining sidewall.

The head 28 preferably carries a rotatable machining insert 82 or tool used to modify a cavity 25 of a die 24 to prevent blank or slug pulling during stamping press operation. A preferred the machining insert 82 is a rotary grinding bit such as a rotary grinding bit of a grinder or die grinder with the bit being used to machine or otherwise form an elongate slug retention groove 22 in part of a die 24 disposed in a cavity 25 in the die 24 that preferably is a die cavity 25 defining sidewall 27 that forms at least part of the die cavity 25. The grinder 80 is mounted in a clamping assembly 110 that permits movement of the grinding bit 82 along the second axis by loosening the clamping assembly 110, moving the grinder 80 within the clamping assembly 110, and then tightening the clamping assembly 110. The grinder 80 is mounted in the clamping assembly 110 in a manner that permits movement of a tip of a grinding bit 82 of the pencil grinder or micro-grinder along the second axis relative to the die enabling the tip of the grinding bit 82 to be moved closer to the die or farther away from the die 24. The grinder 80 preferably is a pencil grinder or micro grinder that can be pneumatically powered.

The clamping assembly 110 can be formed of a plurality of clamping blocks in which the grinder 80 is releasably clamped therebetween in a manner that enables the position of the grinder 80 and its grinding bit generally along the second axis relative to the die enabling the position of the grinding bit 82 to be adjusted relative to a cavity of the die in which a slug retention groove 22 is going to be formed.

The machine 20 can have a position measurement device 66 in operable cooperation with the carriage 74 and/or generally horizontal slide to enable a position of the carriage 74 as well as the grinding bit 82 relative to the die cavity 25 to be monitored and/or set. The position measurement device 66 can include a display 70 to provide position feedback to a user during positioning of the grinding bit 82 relative to the die cavity 25 in preparation for slug retention groove 22 formation. One preferred position measurement device 66 is a micrometer configured to enable the magnitude of movement of the carriage 74 along the generally horizontal or first axis to be set, monitored and/or displayed during carriage 74 movement. The position measurement device 66 has a manipulable actuator that causes movement of the carriage 74 along the slide when manipulated by as user enabling relatively precise positioning of the cutting, bit 82 relative to the die cavity 25 defining sidewall 27 in which the slug retention groove 22 is going to be machined. One preferred micrometer is a depth micrometer with the micrometer having a knob 72 that is manipulated by a user to move the carriage 74 along the slide to position the cutting bit 82 relative to the die cavity 25 defining sidewall 27.

The machine 20 is portable and lightweight having a weight less than ten pounds. The machine 20 has a magnetic base 30 enabling the machine 20 to be mounted in nearly any position including within a die in a stamping press 26. The machining head 28 preferably includes an illumination arrangement 158 such as one formed of lights, such as LED lights, arranged around the grinder clamping in the clamping assembly 110 of the head 28 to illuminate the part of the die 24 and die cavity 25 defining sidewall 27 in which a slug retention groove 22 is being machined and during machining of the slug retention groove 22. The machining head 28 can carry or serve as a mount for an imaging device that enables a user to better or more clearly see the portion of the die cavity 25 and the die cavity 25 defining sidewall 27 in which a slug retention groove 22 is going to be machined prior to and during machining of the groove 22. A preferred imaging device 160 includes a camera that preferably is a digital camera capable of being linked to another device, such as a display screen, tablet, personal computer, smart phone, or the link, such as via a USB, Bluetooth, Wi-Fi or other type of wired/wireless link.

One preferred embodiment of a machine 20 for modifying a die 24 to provide slug retention includes a magnetic base 30, a carriage 74 comprised of (a) a generally horizontal slide enabling movement of the carriage 74 relative to a cavity 25 in the die 24 along a generally horizontal axis, and (b) a carriage position measurement device 66 enabling measurement of a change in position of the carriage 74 during movement of the carriage 74 along the first slide 44 and having a manipulable actuator that is manipulable to change the position of the carriage 74 by moving the carriage 74 along the first slide 44; and a machining head 28 that includes an angularly adjustable rotary cutting bit 82 and a generally vertical slide 104 enabling movement of the machining head along a generally vertical axis relative to a die cavity 25 of the die 24 in machining a slug retention groove 22 in a portion of the die disposed in the die cavity.

Understandably, the present invention has been described above in terms of one or more preferred embodiments and methods. It is recognized that various alternatives and modifications may be made to these embodiments and methods, which may include alternative combinations of two or more of the individual features mentioned from the same or different drawings or as otherwise evident from the text and/or drawings, and which are within the scope of the present invention.

What is claimed is:

1. A machine for modifying a die to provide slug retention comprising:

a magnetic base that enables the machine to be removably attached to a magnetically attractive surface;

a carriage adjustable along a first axis; and a machining head comprising a machining insert used to modify the die to provide slug retention, the machining head carried by the carriage and adjustable along a second axis.

2. The machine of claim 1 wherein the machining head comprises a tool holder that releasably holds a machining tool to which the machining insert used to modify a cavity of the die to prevent blank or slug pulling during stamping press operation is mounted.

3. The machine of claim 1 wherein the machining head comprises a clamp that releasably clamps a rotary grinder, and wherein the machining insert is a rotary grinding bit mourned to the rotary grinder.

4. The machine of claim 1 wherein the carriage is cantilevered from the base disposing the machining head outwardly of the base, wherein the carriage is movable relative to the base along the first axis moving the machining head therewith, the first axis generally perpendicular to the direction of a punch traveling into the cavity of the die during stamping, and wherein the machining head is movable relative to the carriage and base along the second axis, the second axis generally parallel to the direction of the punch traveling into the cavity of the die during stamping.

5. The machine of claim 1 wherein the machining head is disposed outwardly of the base and movable relative to the carriage along the second axis generally parallel to a direction of a punch traveling into the cavity of the die during stamping moving the machining insert relative to the carriage and second axis toward or away from the die being modified to provide slug retention.

6. The machine of claim 5 wherein the machining head is angularly adjustable relative to the carriage and second axis to adjust the angle of the machining insert relative to the second axis and die punch travel direction.

7. The machine of claim 6 wherein the machining insert is a rotary grinding bit that machines an elongate slug retention groove into a die cavity defining sidewall that forms at least part of the cavity of the die that is oriented at an acute angle relative to the direction of the punch traveling into the die cavity during stamping.

8. The machine of claim 1 further comprising a first slide enabling adjustment of the carriage relative to the base along the first axis moving the machining head toward or away from a die cavity defining sidewall of a die cavity formed in a stamping die and a second slide enabling movement of the machining head relative to the carriage and base along the second axis into or out of the die cavity formed in the stamping die.

9. The machine of claim 8 further comprising a micrometer in operable cooperation with the first slide enabling the magnitude of movement of the carriage along the first axis to be displayed during carriage movement.

10. The machine of claim 9 further comprising an actuator in operable cooperation with the micrometer and the first slide, and wherein manipulation of the actuator causes the first slide to move the carriage along the first axis.

11. The machine of claim 10 wherein the actuator comprises a manipulable knob of the micrometer.

12. A machine for modifying a die to provide slug retention comprising:

a base that substantially immovably fixes the machine in place relative to the die;

a carriage carried by the base, the carriage comprised of (a) a carriage mount carried by a first slide enabling movement of the carriage relative to a cavity in the die along a first axis that is generally parallel to a surface of the die, and (b) a machining head support carried by the carriage mount, the carriage mount extending outwardly beyond the base disposing the machining head support outwardly of the base; and a machining head carried by the machining head support and disposed outwardly of the base, the machining head comprised of (a) a machining tool having a rotary cutting bit with a cutting axis about which the rotary cutting bit rotates, and (b) a second slide enabling movement of the machining head and rotary cutting bit relative to the carriage along a second axis that is generally perpendicular to the first axis toward or away from a die cavity of the die in machining a slug retention groove in a portion of the die disposed in the die cavity; and wherein the machining tool is angularly adjustable relative to the second axis enabling the cutting axis of the rotary cutting bit of the machining tool to be oriented at an acute angle relative to the second axis.

13. The machine of claim 1 further comprising an angular adjustment arrangement enabling adjustment of the angle of the machining head relative to the second axis.

14. The machine of claim 13 wherein the angular adjustment arrangement comprises a swivel assembly in operable cooperation with the machining head enabling angular adjustment of a rotational axis of the machining insert relative to the second axis.

15. The machine of claim 14 wherein swivel assembly comprises a swivel plate carrying the machining head that is attached to the carriage by a pivot and a manipulable swivel plate clamping knob that rides in an elongate angle adjustment enabling slot formed in the carriage.

16. The machine of claim 15 wherein the swivel assembly enables angular adjustment of the rotational axis of the cutting insert to an angle formed between the cutting insert rotational axis and second axis that is within ±15 degrees of the second axis.

17. The machine of claim 1 wherein the carriage is extends outwardly from the base beyond the base, the carriage movable relative to the base along the first axis in a generally horizontal direction, and wherein the machining head is mounted to the carriage and disposed outwardly of the base, the machining head movable along the first is in a generally vertical direction.

18. The machine of claim 1 wherein the machining insert comprises a rotary grinding bit, and wherein the machining head comprises a pencil grinder or micro-grinder mounted in a clamping assembly that permits movement of the grinding bit along the second axis by enabling the pencil grinder or micro-grinder to be clamped by the clamping assembly closer to or farther away from the die.

19. The machine of claim 12 wherein the carriage is cantilevered outwardly from the base with the machining head disposed at an end of the carriage, wherein the machining head is adjustable along the second axis by moving the machining head relative to the carriage along the second axis, wherein the machining insert comprises a cutting bit rotatable about an axis of rotation, and wherein the machining head is angularly adjustable relative to the second axis and the carriage adjusting the angle of the machining insert axis of rotation relative to the second axis.

20. The machine of claim 1 wherein the slug retention machine is transportable enabling the slug retention machine to be used to modify a die in a stamping press or a die disposed in a tool room.

21. The machine of claim 12 wherein the carriage is generally T-shaped with (a) the carriage mount extending generally horizontally and overlying the base, and (b) the machining head support extending generally vertically from a free end of the carriage mount, and wherein the machining head is mounted to the machining head support, the machining head extending generally vertically.

22. The machine of claim 1 wherein the machine is portable and weighs less than 10 pounds.

23. The machine of claim 12 wherein the machine is portable and weighs less than 10 pounds.

24. The machine of claim 12 wherein the carriage further comprises a carriage position measurement device having a display.

25. The machine of claim 12 wherein the base comprises a magnetic base.

26. A machine for modifying a die to provide slug retention comprising:

a magnetic base;

carriage comprised of (a) a generally horizontal slide enabling movement of the carriage relative to a cavity in the die along a generally horizontal axis, and (b) a carriage position measurement device enabling measurement of a change in position of the carriage during movement of the carriage along the first slide and having a manipulable actuator that is manipulable to change the position of the carriage by moving the carriage along the first slide; and a machining head comprised of an angularly adjustable rotary cutting bit and a generally vertical slide enabling movement of the machining head along a generally vertical axis relative to a die cavity of the die in machining a slug retention groove in a portion of the die disposed in the die cavity.

27. The machine of claim 26 wherein the machining head comprises a tool holder removably holding a rotary grinder that rotates the rotary cutting bit, the rotary grinder movable relative to the machining head along the vertical axis.

28. The machine of claim 26 wherein the machining head comprises a tool clamping assembly releasably holding a pneumatically powered pencil or micro-air grinder, the rotary cutting bit mounted to the grinder.

29. The machine of claim 26 wherein the carriage extends outwardly beyond the base disposing the machining head outwardly of the base, and wherein the vertical slide is configured to enable movement of the machining head relative to the base and carriage along the vertical axis.

30. The machine of claim 26 wherein the carriage comprises (a) a generally horizontally extending carriage mount overlying the base extending generally horizontally outwardly beyond the base, and (b) a generally vertically extending machining head support to which the machining head is angularly adjustably mounted, the machining head support carried by the carriage mount and disposed outwardly of the base disposing the machining head outwardly of the base.

31. The machine of claim 26 wherein the position measurement device comprises a micrometer.

32. The machine of claim 26 further comprising a light illumination system that illuminates the rotary cutting bit and an imaging device that enables a user to see the cutting bit.

* * * * *

UNITED STATES PATENT AND TRADEMARK OFFICE

CERTIFICATE OF CORRECTION

PATENT NO. : 9,149,902 B2
APPLICATION NO. : 13/828399
DATED : October 6, 2015
INVENTOR(S) : DeCore et al.

It is certified that error appears in the above-identified patent and that said Letters Patent is hereby corrected as shown below:

Claims

In Claim 3, Column 18, Line 50, replace “mourned” with -- mounted --.

In Claim 17, Column 20, Line 6, replace “carriage is extends” with -- carriage extends --.

In Claim 17, Column 20, Line 11, replace “along the first is in” with -- along the first axis in --.

Signed and Sealed this
Eighth Day of March, 2016

Michelle K. Lee

Michelle K. Lee
*Director of the United States Patent and Trademark Office*